United States Patent [19]

Rexius et al.

[11] Patent Number: 4,979,960

[45] Date of Patent: Dec. 25, 1990

[54] APPARATUS FOR AND METHOD OF COLORING WOOD BY-PRODUCTS

[75] Inventors: Arlen Rexius; John L. Hoeck, Jr., both of Eugene, Oreg.

[73] Assignee: Rexius Forest By-Products, Inc., Eugene, Oreg.

[21] Appl. No.: 337,925

[22] Filed: Apr. 14, 1989

[51] Int. Cl.[5] ..... D06P 3/60

[52] U.S. Cl. ..... 8/402; 8/680

[58] Field of Search ..... 8/402

[56] References Cited

U.S. PATENT DOCUMENTS

| | | | |
|---|---|---|---|
| 3,839,073 | 10/1974 | Hill | 8/402 |
| 3,900,615 | 8/1975 | Dunn | 8/402 |
| 4,478,896 | 10/1984 | Barnes et al. | 427/421 |
| 4,551,191 | 11/1985 | Kock et al. | 156/276 |
| 4,737,154 | 4/1988 | Gaines et al. | 8/402 |

*Primary Examiner*—A. Lionel Clingman

*Attorney, Agent, or Firm*—James D. Givnan, Jr.

[57] ABSTRACT

An apparatus and method for coloring aggregate wood material by directing a flow of material onto vertically spaced, perforate conveyors with each conveyor served by conduits discharging curtains of liquid dye. A drive system for the conveyors includes the provision of driving the conveyors at different speeds to increase aggregate depth for saturation purposes. Conduits of the spray system have oversized orifices directing discharges onto deflectors for curtain formation. Curtain impingement includes the aggregate material in transition in between conveyors. An inclined conveyor and pan returns dye removed from the material to a catch basin.

3 Claims, 1 Drawing Sheet

APPARATUS FOR AND METHOD OF COLORING WOOD BY-PRODUCTS

BACKGROUND OF THE INVENTION

The present invention concerns the treating of wood aggregate in the manufacture of products for use in the home.

A market has been established for multi-colored wood shavings which are also scented and packaged to constitute potpouri. Such a product has been well received in the marketplace. Typically the dyed shavings are packaged in a manner providing a variety of sizes, colors and scents.

Attempts to saturate the shavings by submerging a batch or quantity of same in a bath have proved impractical from a production standpoint.

In the prior art, U.S. Pat. No. 1,120,730 discloses vertically spaced, endless conveyors with spray nozzles discharging onto the conveyor material as well as material gravitating therebetween. U.S. Pat. No. 2,878,776 discloses an apparatus with endless, perforate conveyors in staggered relationship with an additional conveyor depositing granular material onto the uppermost conveyor with the material discharged gravitating through all of the conveyors toward a sump U.S. Pat. No. 2,923,138 discloses stacked conveyors horizontally offset from adjacent conveyors for the serpentine passage of food articles to be frozen. A single chain drive powers the conveyors at a uniform speed. U.S. Pat. No. 3,049,134 discloses a washing apparatus for aerosol cans with water conduits extending parallel to can conveyor runs with nozzles discharging sprays toward the can ends. U.S. Pat. No. 3,269,297 discloses endless conveyors arranged in series and transferring material therealong with some conveyors having spray nozzles disposed thereabove while a terminal conveyor is provided with a drying flow of air. U.S. Pat. No 3,467,063 discloses a conveyor having vertically spaced runs with articles supported on each run subjected to adhesive deposits. U.S. Pat. No. 4,478,896 discloses horizontally and vertically offset conveyors with wood strands, between conveyor run, being subjected to nozzle discharged sprays of resin.

SUMMARY OF THE PRESENT INVENTION

The present invention is embodied within an apparatus and method of treating wood by-products to color same.

One suitable wood by-product are shavings resulting from lumber manufacturing operations such as planing. The shavings are of irregular shape and size and of a thickness suitable for dyeing with virtually uniform color dispersion. It hs been determined most practical to process the shavings in a continuous manner. Retention of the dye during processing is enhanced by increasing material depth after initial treating of the shavings. Such varying of batch depth may be conveniently accomplished by reduced conveyor speed.

A supply of wood by-product material such as wood shavings in a mixed mass is deposited on the first conveyor of a series of conveyors. The deposited material is dispersed across the first conveyor and subjected to several curtains of dye. Downstream conveyors carry material deposited thereon with additional dye being added to the conveyed material. Prior to discharge from the series of conveyors and from a spray housing, the depth of the material is increased to enhance color transfer. The dyed material is also conveyed along a draining conveyor prior to discharge into a gas fired dryer. During dyeing of the wood material, the same are subjected both to spray curtains and to dye gravitating through the material and through the perforate belts of the conveyors.

Important objectives of the present invention include the provision of an apparatus for dyeing wood aggregate in a continuous manner; the provision of an apparatus subjecting wood particles to liquid dye by conveying the shavings through curtains of dye at different conveyor speeds to alter the depth of material on the conveyors; the provision of an apparatus having large orifice, non-clogging spray components including deflectors dispersing the dye into curtains; the provision of a method of continuously dyeing a flow of wood shavings wherein the depth of wood shavings is varied between conveyor carried masses to promote dye saturation.

DETAILED DESCRIPTION OF THE PREFERRED EMBODIMENTS

Figure 1:
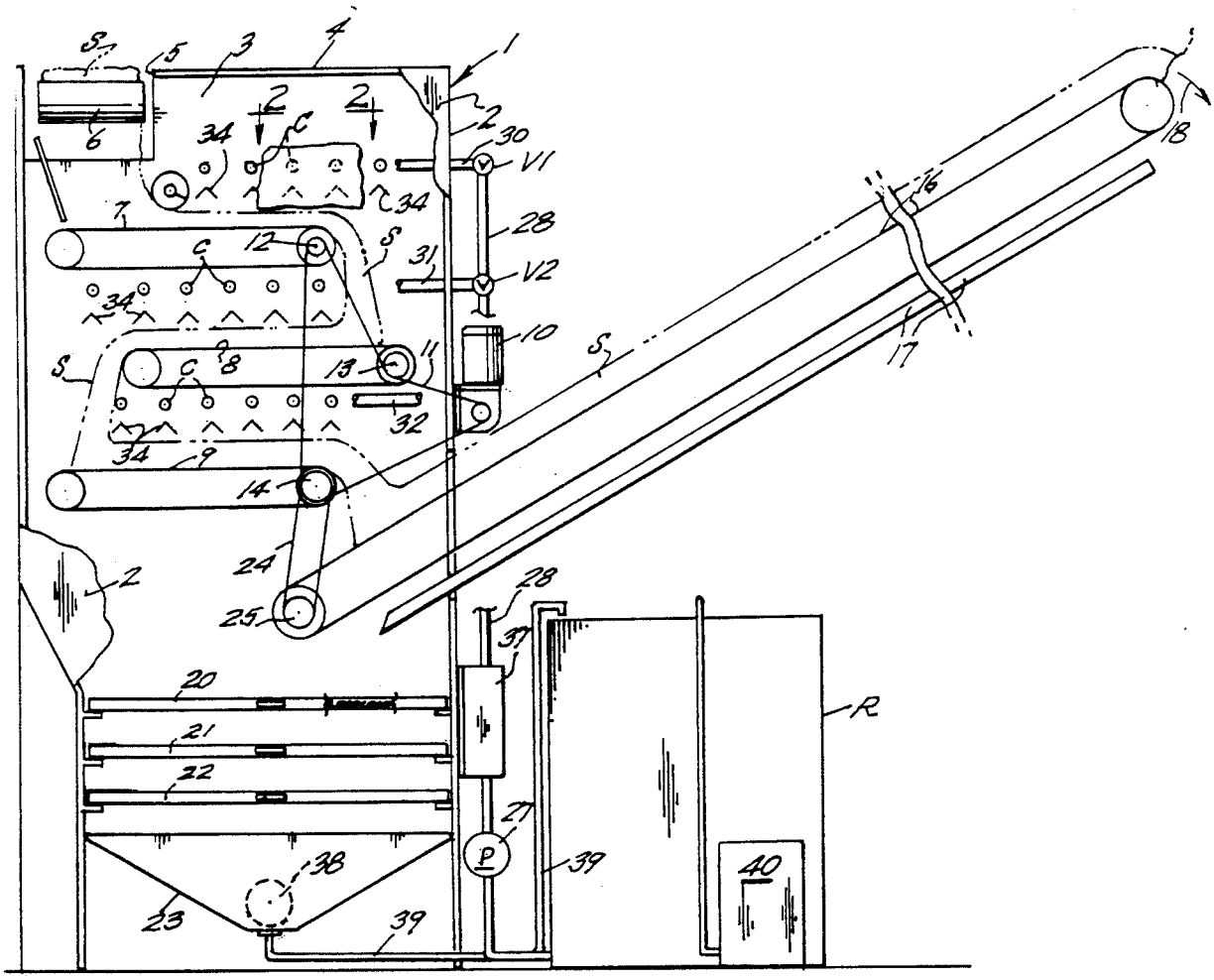
FIG. 1 is a schematic elevational view of the present apparatus.
Figure 2:
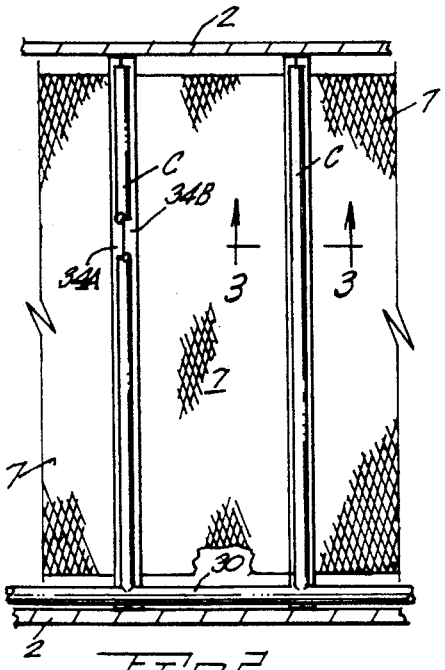
FIG. 2 is a horizontal plan view taken along 2—2 of FIG. 1.

With continuing attention to the drawings wherein applied reference numerals indicates parts similarly hereinafter identified, the reference numeral 1 indicates generally a housing of the present apparatus.

Housing side walls as at 2 define an apparatus interior 3 while top wall 4 has an open area 5 to receive the discharge end 6 of a belt conveyor for the constant delivery of wood by-products such as shaving S.

A series of endless conveyors comprise a first conveyor 7, second conveyor 8 and a third conveyor 9 vertically offset from one another to convey material in serpentine fashion downwardly through the housing. The conveyors have roll carried, open mesh belts to permit fluid flow, as later described, to gravitate through the wood material on the series of conveyors. For driving the conveyors, a gear head motor 10 drives a roller chain 11 entrained on driven conveyor sprockets 12, 13 and 14. For the purpose of increasing the depth of the wood by-product on conveyor 9 by reduced conveyor speed, sprocket 14 is of greater size than sprocket 12.

An inclined conveyor at 16 is also of perforate construction to permit draining of the material thereon during inclined passage toward off loading indicated by arrow 18 to a dryer. A tray 17 serves to collect the dye solution from conveyor 16 and return same to the housing interior and to filters at 20, 21 and 22 above a catch basin 23. The continuous belt on conveyor 16 may be driven off conveyor 9 by a roller chain drive 24 including a driven sprocket 25.

A spray system includes a pump 27 having discharge conduit 28 with branch conduits at 30, 31 and 32 with each branch conduit serving lateral spray conduits C disposed transversely above the conveyors 7, 8 and 9. The lateral conduits each define multiple ports as at 33 for dye solution discharge toward a parallel, subjacent deflector 34 as typically showwn in FIG. 3. The deflectors have inclined surfaces at 34A–34B to form liquid curtains 35 and 36 which along with the curtain flows from other ports 33 in the conduit provide a continuous liquid curtain across the conveyed material.

Valves as at V1 and V2 permit regulation of fluid flows to branch conduits 30, 31 and 32. The spray system draws fluid from a reservoir R with pump 27 delivering fluid flow to a heater 37 and thence to the branch conduits. Catch basin 23 collects dye subsequent to filtering by passage through filters 20, 21 and 22 each with a different mesh screen. A pump 38 in catch basin 23 delivers dye solution back to reservoir R via line 39. For purposes of conveniently changing dye colors, the reservoir R may be served by flexible hoses for insertion into the reservoir. A dye mixing tank at 40 permits per-mixing of the water soluble acid dye in powdered form prior to the discharge of the solution into the reservoir. The ratio of dye to water will of course vary depending on the intensity of color desired in the wood shavings.

The foregoing apparatus permits the coloring of wood aggregate material in a continuous, high volume manner. A preferred way of accomplishing the variance in material depth is to vary sprocket size of the driven sprockets 12, 13 and 14 of conveyors 7, 8 and 9. The reduction in speed of conveyor 9 and the subsequent increase of the shaving depth thereon subjects the shavings to an absorbed quantity of dye retained in the greater depth of material.

Figure 3:
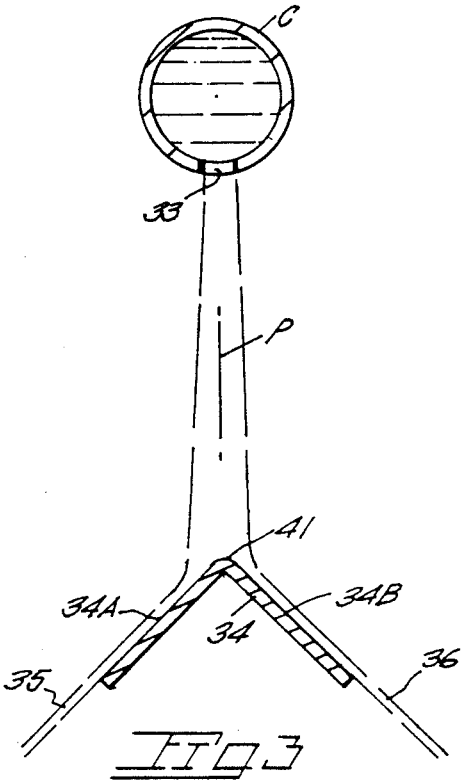
FIG. 3 is a vertical sectional view taken along line 3—3 of FIG. 2.

With attention to FIG. 3, it will be seen that the deflectors 18 may be of angle stock with the angle apex at 41 in a plane P containing the major axis of a conduit C. Accordingly, the discharge is shaped into curtain shaped flows 35 and 36. Spacing of the conduit orifices is such as to cause the curtain shaped flows 35 and 36 to overlap curtain shaped flows emanating from adjacent conduit orifices to assure unbroken curtains of dye solution extending fully across the conveyed material. Further, dye flows impinge the aggregate of wood shavings during transfer between conveyors when the material has somewhat dispersed to enhance dye dispersion. Acid dyes with a water solvent have proved suitable for present purposes and result in dye solution absorption into the wood shavings.

One suitable embodiment of the present apparatus accomplishes suitable dye delivery to the conveyed material with pump 27 having a rating of 180 GPM at 20 psi. Conveyor speeds of conveyors 7, 8 and 9 have been found satisfactory when at 3, 2 and 1 feet per minute respectively.

While we have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A method of coloring wood by-product material such as wood shavings in an aggregate mass and consisting in the steps of, depositing of a continuous flow of wood material onto a first conveyor of a series of conveyors, directing flows of dye solution of water and an acidic dye onto the material during material passage along said first conveyor and during material passage along the remaining conveyors of said series of conveyors;

driving one of said remaining conveyors of said series at a slower speed than said first conveyor so as to cause the thickness of material to be greater on said one conveyor to prolong exposure of the material to the dye solution to promote material coloring by absorption of the dye solution.

2. A method of coloring wood particles consisting in the steps of, directing a continuous flow of the particles onto a first endless conveyor and subsequently onto a second endless conveyor, dispersing a liquid dye solution of water and an acidic dye onto deflectors and subsequently onto the particles during travel along the first and second endless conveyors, and driving said second endless conveyor at a slower speed than said first endless conveyor to increase the thickness of the mass of wood particles thereon to prolong exposure of the particles t the dye to promote dye absorption by the particles and hence coloring of the particles.

3. The method claimed in claim 2 wherein the particles are directed downward onto said second endless conveyor for travel in a direction opposite to the travel of said first endless conveyor so as to subject the particles on the second endless conveyor to the dye solution gravitating from the first endless conveyor.

* * * * *